US009746292B2

(12) United States Patent
Alford et al.

(10) Patent No.: US 9,746,292 B2
(45) Date of Patent: Aug. 29, 2017

(54) EXPLOSIVE CHARGE

(71) Applicant: Alford Research Limited, Chippenham, Wiltshire (GB)

(72) Inventors: Roland Alford, Wiltshire (GB); Sidney Alford, Wiltshire (GB)

(73) Assignee: ALFORD RESEARCH LIMITED, Chippenham, Wiltshire (GB)

( * ) Notice: Subject to any disclaimer, the term of this patent is extended or adjusted under 35 U.S.C. 154(b) by 0 days.

(21) Appl. No.: 14/330,332

(22) Filed: Jul. 14, 2014

(65) Prior Publication Data

US 2015/0247710 A1 Sep. 3, 2015

Related U.S. Application Data

(62) Division of application No. 12/281,594, filed as application No. PCT/GB2007/000776 on Mar. 5, 2007, now abandoned.

(30) Foreign Application Priority Data

Apr. 3, 2006 (GB) ..... 0604408.5

(51) Int. Cl.
*F42B 3/22* (2006.01)
*F42B 1/028* (2006.01)
(Continued)

(52) U.S. Cl.
CPC ..... *F42B 3/22* (2013.01); *F41H 11/11* (2013.01); *F42B 1/024* (2013.01); *F42B 1/028* (2013.01);
(Continued)

(58) Field of Classification Search
CPC ..... F42B 12/10; F42B 12/22; F42B 12/24; F42B 12/367; F42B 12/36; F42B 3/08;
(Continued)

(56) References Cited

U.S. PATENT DOCUMENTS 2,605,704 A 8/1952 Dumas
2,789,504 A 4/1957 McCloud et al.
(Continued)

FOREIGN PATENT DOCUMENTS

DE 284108 10/1913
EP 0769672 4/1997
(Continued)

OTHER PUBLICATIONS

International Preliminary Report on Patentability, PCT/GB2007/000776, Sep. 2008.
(Continued)

*Primary Examiner* — James S Bergin
(74) *Attorney, Agent, or Firm* — McAndrews, Held & Malloy, Ltd.

(57) ABSTRACT

Container (10) is generally cylindrical except for a longitudinal concave groove (11) extending along its entire length. Upon explosion, the contour of this groove (11) results in a focussing effect on the wall material due to the oblique angle at which the expanding cylindrical detonation wave front impacts upon its inner wall. This produces the forging of a rough rod-like projectile ($\mathbf{11}_1$) which, being coherent, maintains its velocity and consequently travels much further than the randomly shaped projectiles ($\mathbf{10}_1$).

9 Claims, 10 Drawing Sheets

(51) Int. Cl.

| | |
|---|---|
| ***F42B 1/032*** | (2006.01) |
| ***F42B 12/24*** | (2006.01) |
| ***F42B 12/10*** | (2006.01) |
| ***F41H 11/11*** | (2006.01) |
| ***F42B 3/08*** | (2006.01) |
| ***F42B 12/36*** | (2006.01) |
| ***F42B 1/024*** | (2006.01) |

(52) U.S. Cl.
CPC ..... *F42B 1/032* (2013.01); *F42B 3/08* (2013.01); *F42B 12/10* (2013.01); *F42B 12/24* (2013.01); *F42B 12/367* (2013.01)

(58) Field of Classification Search
CPC ..... F42B 3/22; F42B 1/00; F42B 1/02; F42B 1/028; F42B 1/032; F42B 12/20; F42B 12/201; F42B 12/204; F41H 11/11
USPC ..... 102/305, 306, 307, 308, 309, 310, 475, 102/476, 331
See application file for complete search history.

(56) References Cited

U.S. PATENT DOCUMENTS

| | | | | |
|---|---|---|---|---|
| 3,176,613 | A | 4/1965 | Godfrey et al. | |
| 3,613,586 | A * | 10/1971 | Talley | F42B 12/26 102/476 |
| 3,853,060 | A * | 12/1974 | Weeding | F42B 12/32 102/495 |
| 3,934,511 | A | 1/1976 | Cordle et al. | |
| 3,960,085 | A | 6/1976 | Abernathy et al. | |
| 4,004,518 | A | 1/1977 | Potteiger et al. | |
| 4,037,539 | A * | 7/1977 | Hackman | F42B 12/14 102/491 |
| 4,297,946 | A | 11/1981 | Paton et al. | |
| 4,327,642 | A | 5/1982 | Grosse-Benne et al. | |
| 5,170,004 | A | 12/1992 | Garrison | |
| 5,383,405 | A | 1/1995 | Everest | |
| 5,744,747 | A | 4/1998 | Renaud-Bezot et al. | |
| 5,792,980 | A | 8/1998 | Weimann | |
| 7,621,221 | B2 | 11/2009 | Ritman | |

FOREIGN PATENT DOCUMENTS

| | | |
|---|---|---|
| EP | 0887616 | 12/1998 |
| GB | 2214618 | 9/1989 |
| WO | 2004/070311 | 8/2004 |

OTHER PUBLICATIONS

International Search Report for PCT/GB07/00776, dated Jul. 4, 2007.

* cited by examiner

EXPLOSIVE CHARGE

The present application is a divisional application of U.S. patent application Ser. No. 12/281,594, filed on Dec. 15, 2008, which application was filed pursuant to 35 U.S.C. 371 as a U.S. National Phase application of International Patent Application No. PCT/GB2007/000776, filed on Mar. 5, 2007, claiming the benefit of priority to Great Britain Patent Application No. 0604408.5, filed on Apr. 3, 2006. Each of the aforementioned applications is hereby incorporated by reference in its entirety.

The present invention relates to an explosive charge.

BACKGROUND

Barbed wire fences or entanglements consisting of one or more extended rolls of barbed wire have long been used in theatres of war as obstacles to infiltration or attack by opposing forces.

Whereas furtive incursion may sometimes be accomplished by cutting strands, one by one, with hand operated wire cutters, such a method exposes the infiltrators to extreme danger if their activity is noticed by the enemy. For this reason, when it has been considered necessary for a body of men to traverse a fence rapidly, manual severing of the fence is typically replaced in favour of using explosives.

Since the First World War, the preferred type of explosive charge to breach wire obstacles with advantageous rapidity has been a device known as "Bangalore Torpedo" used both as a factory-filled item and in improvised versions. The Bangalore Torpedo consists of a thin-walled, cylindrical, metal tube, or arrays of such tubes joined end to end, filled with explosive. Most commonly such tubes are steel and they are filled with a mixture of ammonium nitrate and TNT (amatol) or with TNT alone; improvised versions have consisted of steel pipes filled with guncotton primers. These charges are thrust or thrown beneath, through or above the obstacle and, once the operator has retired to a safe distance, are detonated by means of safety fuse or electric detonators.

Individual factory-made charges, which are typically about 1.8 meters long, and of approximately 38 mm diameter, with a wall thickness of approximately 2 mm, and containing approximately 2 kgs of explosive in each unit, are provided with bayonet fittings or screw threads at their ends so that they can be quickly assembled into a linear array when this is necessary. One end of the charge, or the charge array, is provided with a pointed, rounded, or ogival nose in order to facilitate the sliding over possibly rough ground or the easy insertion into a wire entanglement without snagging.

The charge depends for its effectiveness upon the blast effect of the explosive it contains which both stretches adjacent strands of wire to the extent that they break and displaces them to either side, thereby forming a gap in the obstacle wide enough for one or more combatants to pass through. The effect is enhanced by the impact of fragments of the tubular case which are projected at high velocity in radial directions.

Such charges may also be used for the displacement or the destruction and consequent rendering safe of anti-personnel or anti-vehicle mines lying on the ground's surface or buried a short distance beneath and also as a tool for general demolition.

It will be understood by those skilled in the art that this type of explosive charge suffers several limitations. The first of these is that the length of the unit charge of the existing Bangalore Torpedo is such that it is awkward to carry and unnecessarily large to use as a means of severing, for example, just a few strands of wire or destroying a small object such as an unexploded projectile or electrical installation.

Another disadvantage derives from the fact that, as a consequence of scaling, in order to double the range at which blast from such a charge would sever a length of wire of a given strength situated to one side, the diameter of the charge would also need to be doubled. This would increase the explosive load four-fold. In practical terms this means that the ability of a charge of given size to sever wire diminishes rapidly with distance.

A further disadvantage of the device is the danger presented to the operator and his colleagues by the very sharp and jagged steel tube fragments of the bursting tube, this danger being exacerbated by the frequent need of an operator intending to breach an obstacle to be as close to the obstacle as possible in order to advance immediately afterwards.

One known way of greatly extending the effective range of charges of high explosive employs the principle of the shaped charge in which the advancing detonation wave front progressively collapses a metal-lined cavity provided in the outer border of the explosive. Collision of the consequently converging increments of the material lining the cavity has a mutually reinforcing effect on their mean velocity. Thus a generally cylindrical mass of explosive, initiated on the long axis at one end and having a metal-lined conical cavity with an apex angle typically between 40° and 100° at the other, squeezes the liner into a "jet", consisting of narrow wire of extremely high velocity with a considerable velocity gradient along its length, the tip travelling much faster than the rear end. Such jets have great penetrating power, but the velocity gradient causes them to break up in flight and the effective range is therefore usually limited to a distance equivalent to a few charge diameters.

If, however, such a charge is provided not with a metal-lined conical cavity but with a shallow indentation, which may be conical but is more commonly approximately spherical or hyperbolic, then the liner material is squeezed along the long axis of the charge but no jet is formed. The consolidated material is projected at a lower velocity than a corresponding jet but, since it is less elongate, it travels as a coherent mass, undergoes much less disintegration and consequently has a very much greater effective range. The projectiles generated by such charges are generally known as "explosively formed projectiles" or EFPs.

This principle of a collapsing metal lined cavity can also be applied to elongate, or linear, shaped charges in which case the cavity consists of a groove running the length of the elongate mass of explosive. Such liners are usually angular in transverse section but cylindrical grooves are also effective. Such charges are most commonly used for making long cuts in flat, circular or undulate steel targets.

Much less frequently used are linear charges with such shallow lined grooves as produce linear EFPs. These produce elongate, rod-like, projectiles which, though less penetrating at close range than linear cutting charges, are capable of producing a practical effect at ranges much greater than those at which linear cutting charges produce useful effects. The shape of the projectiles depends upon the cross-sections of the liner and of the explosive charge.

In order to make wire fences and entanglements more resistant to cutting by whatsoever means, during recent decades types of wire have been introduced which are harder and stronger and thus more resistant to cutting and snapping.

Objects of the Invention

An object of the present invention is to overcome these disadvantages.

SUMMARY OF THE INVENTION

The present invention provides an explosive charge for producing directed fragments upon explosion, the charge comprising a casing having a compartment portion for explosive material, the casing having a concave wall section adjacent and exterior to the compartment portion.

The present invention provides an explosive charge for producing directed fragments upon explosion, the charge comprising a casing having a compartment portion for explosive material, and a wall section with an interior concave shape adjacent and exterior to the compartment portion.

The present invention provides an explosive charge for producing directed fragments upon explosion, the charge comprising a casing having a compartment portion for explosive material, and a shockwave refracting element adjacent and exterior to the compartment portion.

The present invention may include any one or more of the following preferred features:

- the concave wall section comprises a groove;
- the concave wall section forms part of the exterior wall of the charge;
- the concave wall section comprises two flat planar wall elements connected together along one common edge to describe an angle therebetween up to 180°;
- a plurality of concave wall sections;
- the concave wall section has a cross-sectional thickness profile to provide and/or enhance directionality of flight of fragments of the concave wall section after explosion;
- the cross-sectional thickness profile of the concave wall section includes a thickness which reduces with increased distance from the central point of the explosive compartment;
- an inert liner between the explosive and a projectile portion of the charge for attenuating the shock wave;
- a rubber lining of a metal tube forming the casing for the explosive charge;
- the concave wall section comprises a wall element and means to interlock with another such wall element or a standard wall element;
- a corner piece to interconnect the concave wall section with another such concave wall element or standard wall element.

The present invention combines the practicability of a tubular metal container filled with high explosive with the extended effective range of a linear EFP.

Each charge unit may consist of an explosive filled metal tube whose wall thickness is such that it will burst when the explosive is initiated at one end. The wall of the tube is provided with one or more concave wall sections forming longitudinal grooves.

In one embodiment of the invention, the cross section of each groove is such that it forms a rod-like projectile when the charge detonates. In a preferred embodiment, the tube has three, four or five such grooves spaced equidistantly round the tube.

A significant proportion of the energy generated by the explosive is transferred to the metal case. If the case consists of a circular array of linear EFP liners, joined edge to edge, then most of the explosive energy will be directed along radial planes equally spaced round the tube, the position of each plane corresponding to one of the grooves. The severing of the individual wires constituting a wire entanglement will not therefore be dependent only upon sudden deformation caused by a cylindrical blast wave and randomly distributed fragment impact, as with a conventional Bangalore torpedo, but adjacent wires will be cut by linear projectiles at a distance at which blast alone would be unlikely to cause breakage. The greater the number of wire strands cut, and the greater the number of cuts made in each strand, the less the energy required to blow apart the wires and supporting structures on either side of the line of attack.

The preferred number of longitudinal grooves in the tube is a compromise between a large number of shallow and narrow grooves, which would generate a large number of projectiles and therefore strike the wires of an entanglement at more places, and a small number of grooves which, being wider, would produce heavier projectiles which would strike the wires at fewer points but would do so more energetically and thus be more likely to sever them. The former arrangement would have the additional advantage of best approximating a cylindrical array which would accommodate the greatest amount of explosive for an outer envelope of a given diameter.

Though the principal application of the Bangalore torpedo is the breaching of wire fences and entanglements, it will be understood that the invention may also be used for such other applications as the clearing of a path through a minefield and also for general disruption of mechanical and electronic equipment and for the disruption of containers of, for example, fuel.

The addition of igniferous substances to the inside or, more conveniently, the outside of the explosive containing tube provides a means of enhancing the incendive capabilities of the charge. This is of particular advantage when it is required to perforate containers or conductors of inflammable liquids or gases and to ignite the liberated contents.

Conventional Bangalore torpedoes are made using simple steel tubes. These have the advantage of cheapness, hardness and strength and their relatively high density favour the production of fragments of high cutting power. Since, however, the torpedo is intended for short-range applications, the production of sharp fragments of material of high density extends the range at which they constitute a hazard to the users. In one embodiment of the present invention the body is formed by extruding aluminium. This not only facilitates manufacture but, given the relatively low density of aluminium (2.7 g/cm$^3$ compared with 7.9 g/cm$^3$ for steel) produces fragments of very high initial velocity and hence cutting power but which lose their velocity as a result of drag much more quickly so remain potentially dangerous for shorter distances.

For general use and the most consistent performance, it would be preferable for the charges to be factory-filled with explosive. This would preferably be an insensitive explosive, such as a plastic-bonded explosive, for the sake of safety with respect to accidental initiation by shock or excessive heating. In some circumstances, however, it would be advantageous to provide the torpedoes empty but with one end temporarily removable. This would enable the charges to be transported and stored without invoking considerations of explosive hazard. The user would then load the charges in anticipation of an imminent requirement using plastic explosive or, for ease and rapidity of filling, a liquid explosive such as nitromethane, suitably sensitised to initiation by mixing with such sensitising agents as aliphatic amines or as glass microspheres together with a suitable dispersing and thickening agent. The use of such user-filled charges in this way significantly reduces the total amount of explosive needed to be held in or near the place of use. Indeed, unsensitised nitromethane is not generally subject to the restrictions of transportation and storage proper to explosives.

In order to render the unit charges more easily carried, it is preferable that they be provided in shorter lengths than the presently usual 1.5 meters. By providing both ends of each charge unit with suitable joining means, such as a push fit, matching threads or a bayonet fitting, linear arrays of charge units can be readily assembled. Detonation propagation from one charge unit to the next can be facilitated either by abutting thin diaphragms or by arranging the insertion of an explosive-filled axial extension on one unit charge into a matching cavity on the axis of the next. Such a shortening of the body length of each unit charge also greatly facilitates the hand stemming of the interior with plastic explosive.

The present invention includes a kit of parts including any one or more component elements of the charge as described in the present specification.

The present invention is a replacement to the Bangalore Torpedo which has been used for over a hundred years. It is configured as a linear explosively formed projectile (EFP) which is capable of cutting wire obstacles including those made in razor wire which conventional Bangalore Torpedos are incapable of breaching.

The system is a lightweight Anti-Obstacle and General Explosive Engineering Charge to be used in an identical manner to the original Bangalore Torpedo but which offers a number of inherent advantages over the original design.

The present invention incorporates into the design advanced shaped charge technology which enhances the performance by giving the charge a cutting, as well as blasting, effect.

The system makes good many of the perceived shortcomings in the current Bangalore Torpedo without introducing into service any new energetic materials or systems.

The present invention is a multi-patterned linear EFP charge in which multiple cutting "blades" are formed which travel outwards radially, severing obstacles in their path. The blast from the explosive charge then clears the obstacles, leaving a path through the obstacle for the foot soldier to pass.

The present invention may have the same explosive load as a conventional charge, ensuring that the same amount of blast is provided to push the severed wire apart.

The system is offered as factory filled charges which conform to Insensitive Munition Standard STANAG 4439. In addition, as part of the UK's Future Battlefield Explosive Engineering System (FBEES) project, the present invention may be a user-filled Charge Container System. As such, it may be charged with any PE and initiator. It is much more efficient than bulk PE and perform at least as well as the in-service equivalent, while offering capabilities not otherwise available. It is complementary to the fixed-configuration explosive charge system and a highly cost-efficient 'capability multiplier'.

Operator safety is an integral part of the design concept. The charge body is made from extruded aluminium which has excellent cutting performance at short range but which loses momentum rapidly and has limited range, making it inherently safe to use.

BRIEF DESCRIPTION OF THE INVENTION

The invention will be more particularly described with reference to the accompanying drawings in which.

DETAILED DESCRIPTION OF THE INVENTION

Figure 1:
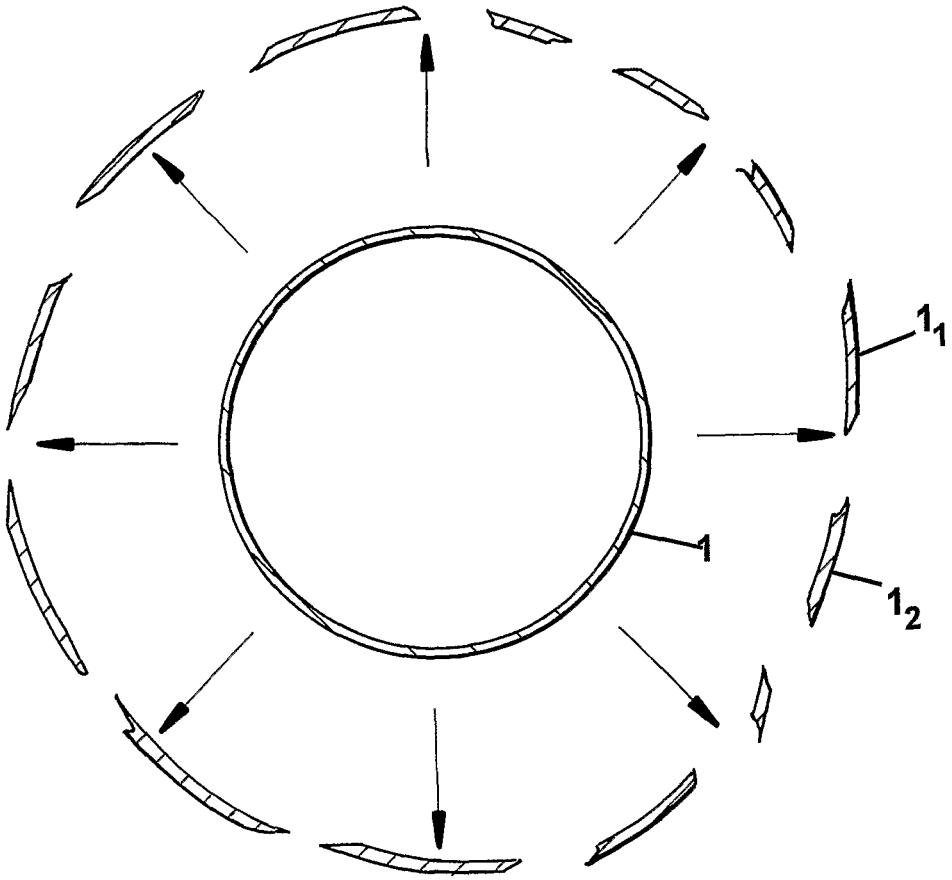
FIG. 1 is a transverse section of a simple prior art cylindrical tubular container, filled with explosive.

FIG. 1 shows the cross-section of a cylindrical container 1 constituting an explosive charge indicating, in broken lines, the resultant fragmentation after detonation of the explosive in the container.

Referring now to FIG. 1, it will be seen that such container or tube 1, being radially symmetrical, expands radially as a result of the shockwave and gas pressure generated by the detonation passing along its length. This will progressively expand the wall of the tube until its elasticity is exceeded and it will suffer many longitudinal fractures.

Since there is misalignment between the longitudinal fractures in adjacent longitudinal increments of tube, many transverse failures will also result and few, if any, long lengths of projectile material $\mathbf{1}_1$, $\mathbf{1}_2$ and so on will survive beyond a distance exceeding the diameter of the tube 1. This is the mode of fracture of conventional Bangalore Torpedoes.

Figure 2:
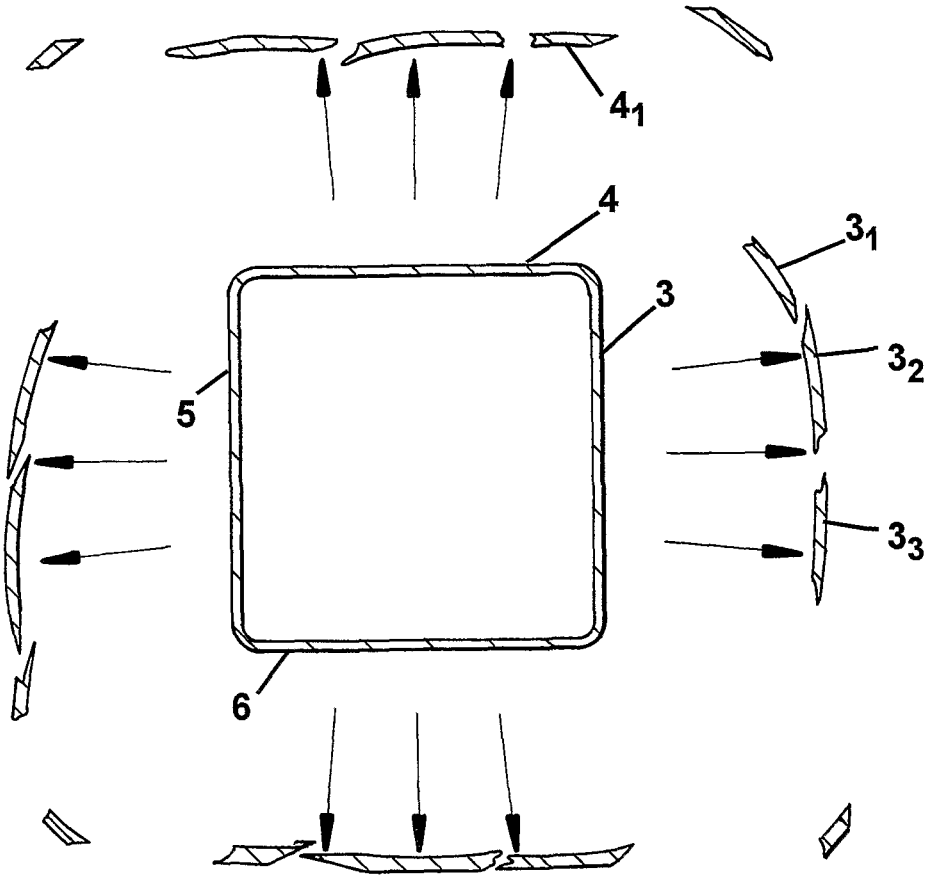
FIG. 2 is a transverse section of a square sectioned tubular container, filled with explosive.

FIG. 2 shows a container with four flat sides 3 to 6 so that, upon explosion, the material will tend to be torn along the corner edges and their radially distributed component increments will diverge more gradually than is the case of the equivalent-sized cylinder 1 shown in FIG. 1. This leads to a greater concentration of projected fragments ($\mathbf{3}_1$, $\mathbf{3}_2$, and so on) in each of the four planes passing through the long axis of the charge and parallel to the flat sides prior to explosion. The fragments 3.1, 3.2, 3.2, etc, follow paths which are closer than those that the same pieces of metal would follow had the tube 5 been circular in section rather than square. In other words, the rate of separation of the elongate fragments in FIG. 2 is lower, so the metal constituting these (potentially separate) fragments tends to break up less and it thus forms larger fragments.

Figure 3:
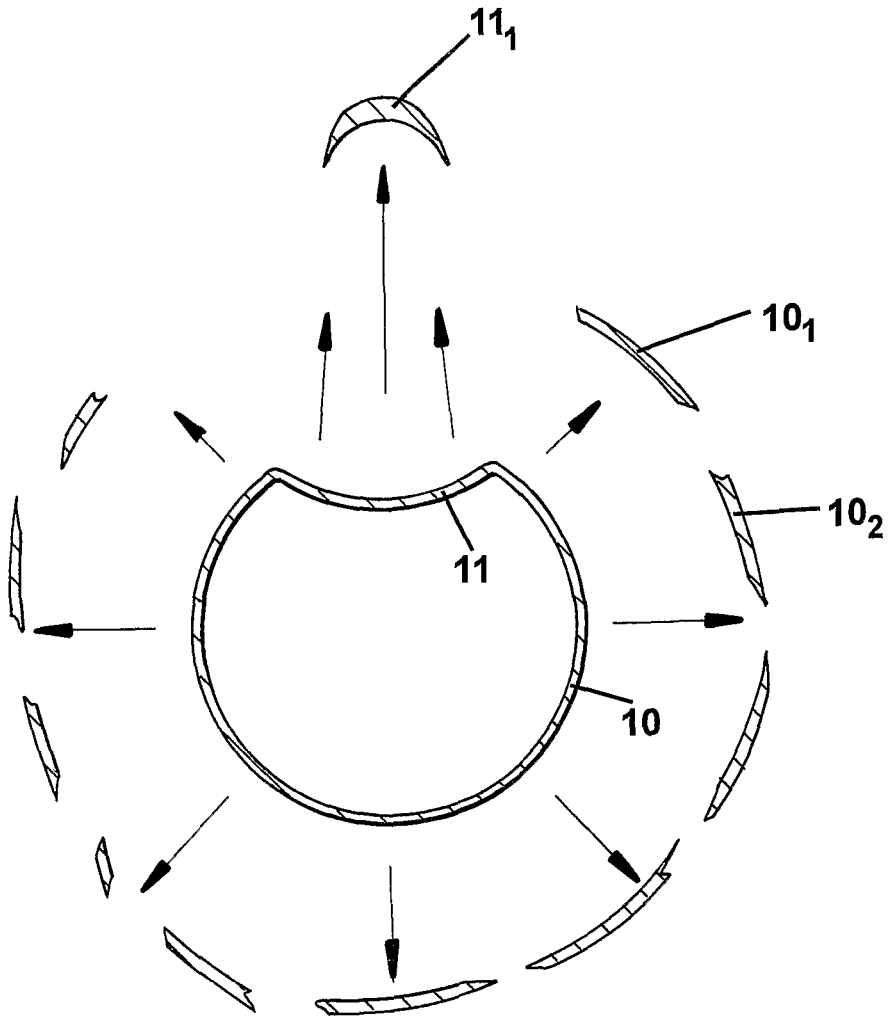
FIG. 3 is a generally cylindrical tubular container according to the present invention provided with an elongate straight, rounded (in cross-section), groove.

FIG. 3 shows a container 10 which is generally cylindrical except for a longitudinal concave groove 11 extending along its entire length.

Most of the wall material derived from explosion of the container or charge 10 shown in FIG. 3 will be distributed with approximate radial symmetry in similar manner to that as shown in FIG. 1 and resulting in fragments $\mathbf{10}_1$, and so on, with the exception of the exploded fragments resulting from the longitudinal groove 11. Upon explosion, the contour of this groove 11 results in a focussing effect on the wall material from which it is constituted, as a result of the oblique angle at which the expanding cylindrical detonation wave front impacts upon its inner wall. This effect produces the forging of a rough rod-like projectile $\mathbf{11}_1$ which, being coherent, and having a much smaller surface area than the randomly shaped projectiles $\mathbf{10}_1$ and so on impelled in other directions, maintains its velocity to a significantly greater extent and consequently travels much further than the latter.

Advantageously, the groove 11 in container 10 is should be straight and not caused to spiral along the tube, since rotation of the groove about the long axis of the charge would cause adjacent increments of the projectile to travel along rotationally-spaced radii. This may produce continuous stretching of the spiral projectile which could result in it breaking up into a large number of short pieces to the detriment of any useful cutting power.

Typically, container 10 has a conical shape at one end to enable the end to be readily stuck in the ground, if appropriate. The container may have, at the other end, some form of connection to another similar container or standard tube, for example a screw-thread portion. In this way, an extensive length of explosive charge can be provided to be effective against a long fence or other obstacle with barbed wire.

Figure 4:
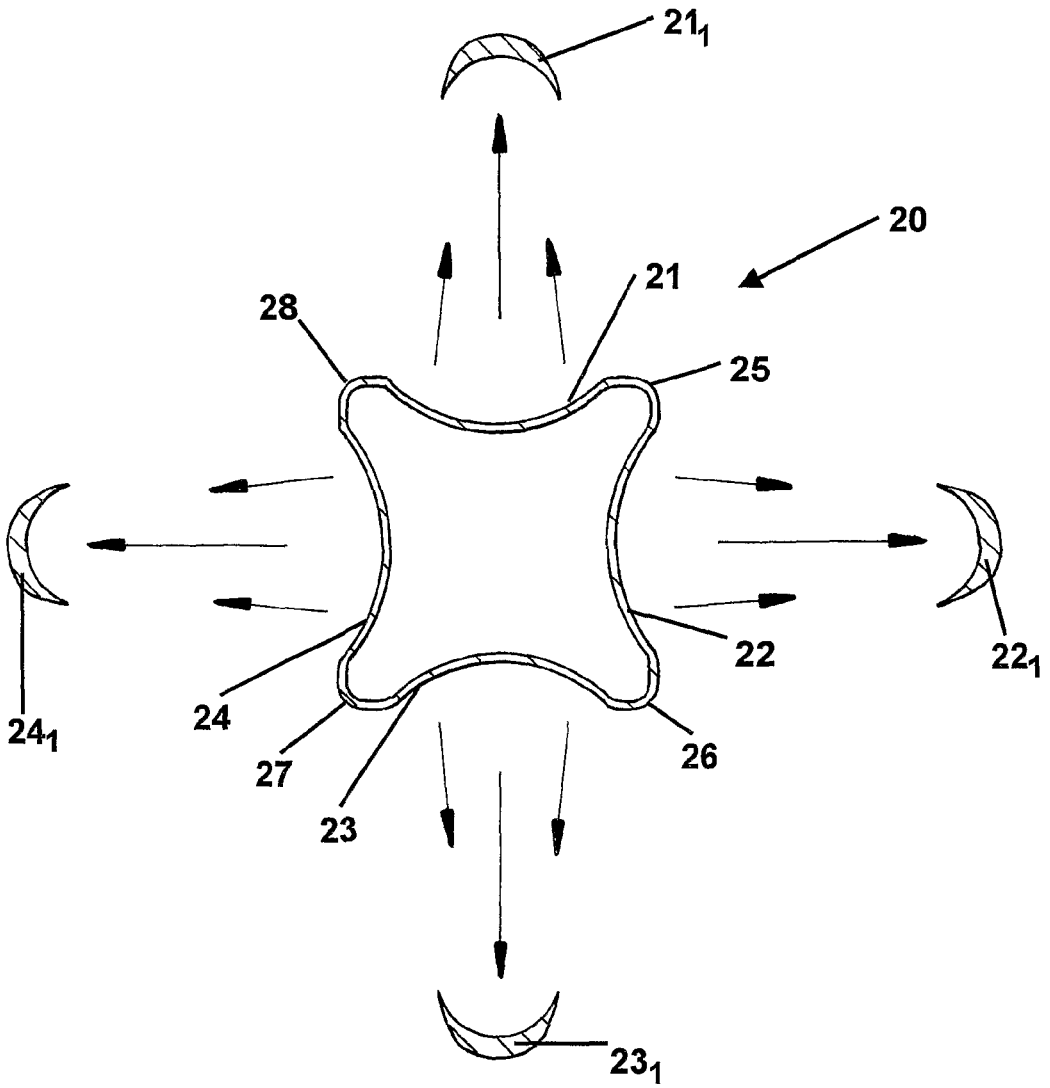
FIG. 4 is a transverse section of a second embodiment of the present invention being a tubular charge which is provided with four equally radially spaced, longitudinal, rounded grooves.

The container 20 of FIG. 4 comprises four concave longitudinal flutes 21 to 24 shown in cross-section as being linked by web-portion wall portions 25 to 28.

Much greater use is made of the focussing effect in the charge shown in FIG. 4, in which almost all the exploded wall material $\mathbf{21}_1$, $\mathbf{22}_1$, $\mathbf{23}_1$, $\mathbf{24}_1$ is constrained within one or other of the four flutes 21 to 24 in its wall. In the previous Figure (FIG. 3), no more than a quarter of the metal constituted the grooved portion and was thus destined to be formed into a coherent linear projectile: in the shape shown in FIG. 4, about 90% of the metal ultimately constitutes linear fragment projectiles. Such an arrangement has the advantage that a cutting effect will be applied in four equally spaced directions, thereby increasing the probability of a strike. By way of example, were a charge unit to be thrown or dragged without regard to its radial orientation beneath a parked aircraft, upon detonation of the charge that aircraft would nevertheless be struck by at least one upwardly directed projectile. In the extreme case of the charge being passed through a loop in a helical wire fence, then the wire constituting that loop is likely to be cut in four places.

Figure 5:
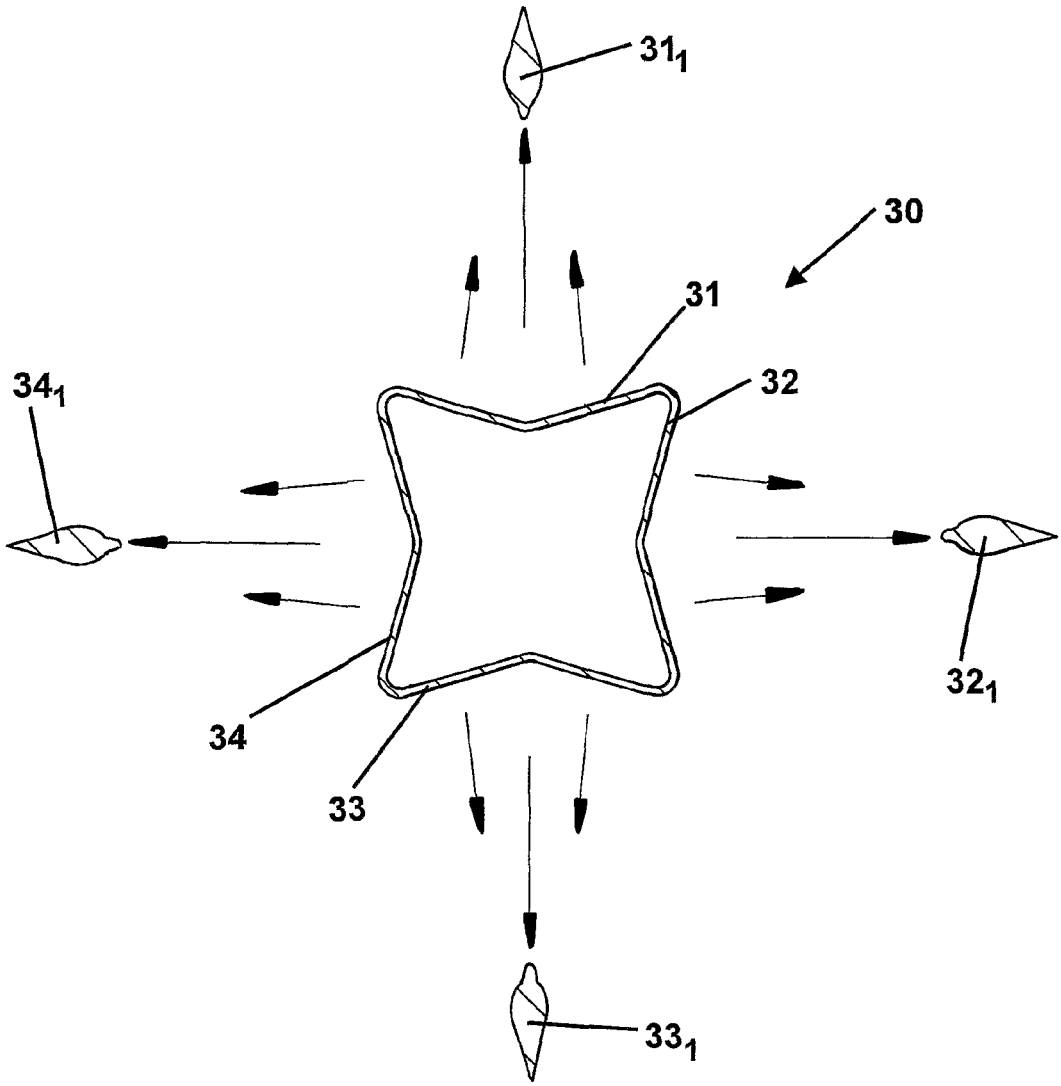
FIG. 5 is a transverse section of a third embodiment of the present invention being a tubular charge which is provided with four equally radially spaced angled grooves.

The container 30 of FIG. 5 has four longitudinal flutes 31 to 34, each of two flat walls 35, 36 angled at about 145°.

Container 30 produces projectile material 31, consisting of angular rather than rounded grooves with higher velocities. To some extent, the velocity of the projectile could be increased by decreasing the angle of the groove. This would, however, decrease the volume available for containing the explosive so, beyond an optimally small angle, the reduced amount of available energy would cause a loss of velocity of the projectiles 31, 32, and so on.

Figure 6:
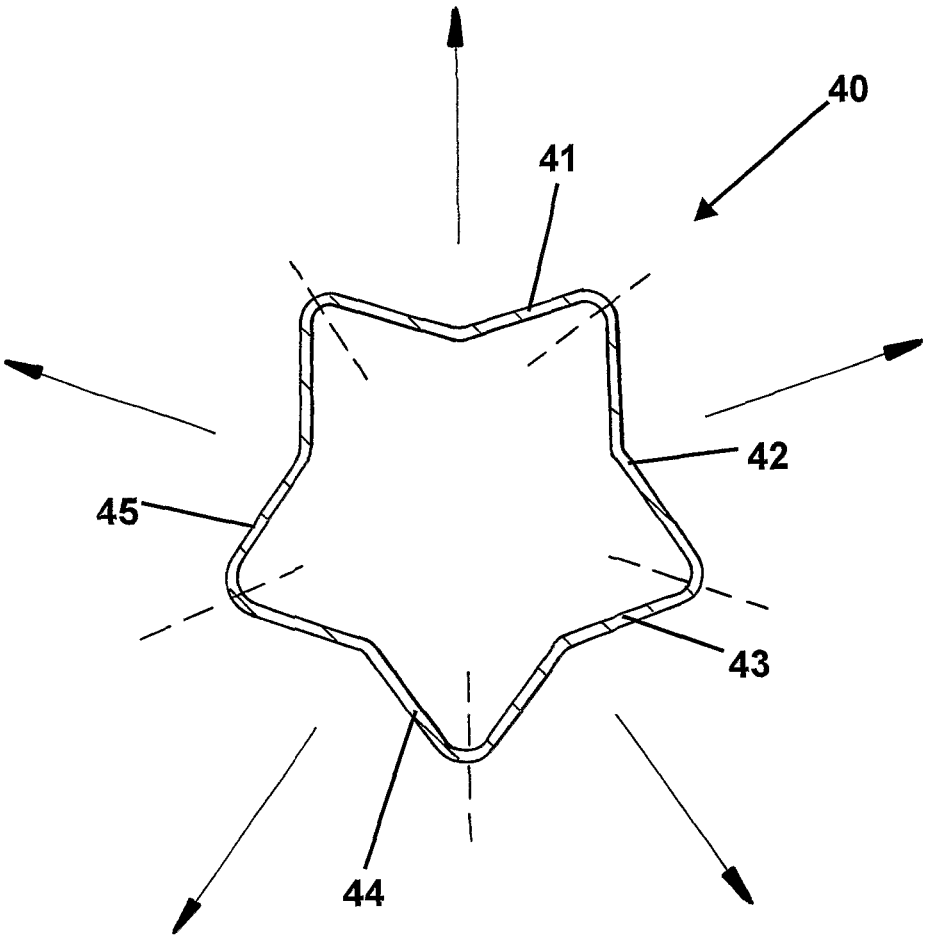
FIG. 6 is a transverse section of a forth embodiment of the present invention being a tubular charge which is provided with five equally radially spaced angled grooves.

FIG. 6 shows a transverse section of a container or charge 40 which is provided with five equally radially spaced angled grooves 41 to 45, resulting in generally similar properties to container 30 illustrated by FIG. 5 except that the probability of impact on a particular target or target component is correspondingly augmented. The diminution of width of each projectile element is somewhat balanced by an increase in internal volume and, hence, of explosive load for a given charge diameter.

It will be understood that both round and square-sectioned steel and aluminium tubes are common articles of commerce. Thus the bodies of charges based upon the shapes shown in FIGS. 1 & 2 could be bought in items. Containers shaped as shown in FIGS. 3, 4, 5 and 6, however, would need to be made for the purpose.

Containers shaped as shown in FIGS. 3 and 6 can be readily formed by rolling or pressing round tubes, and those of FIGS. 4 and 5 by rolling or pressing square tubes.

Figure 7:
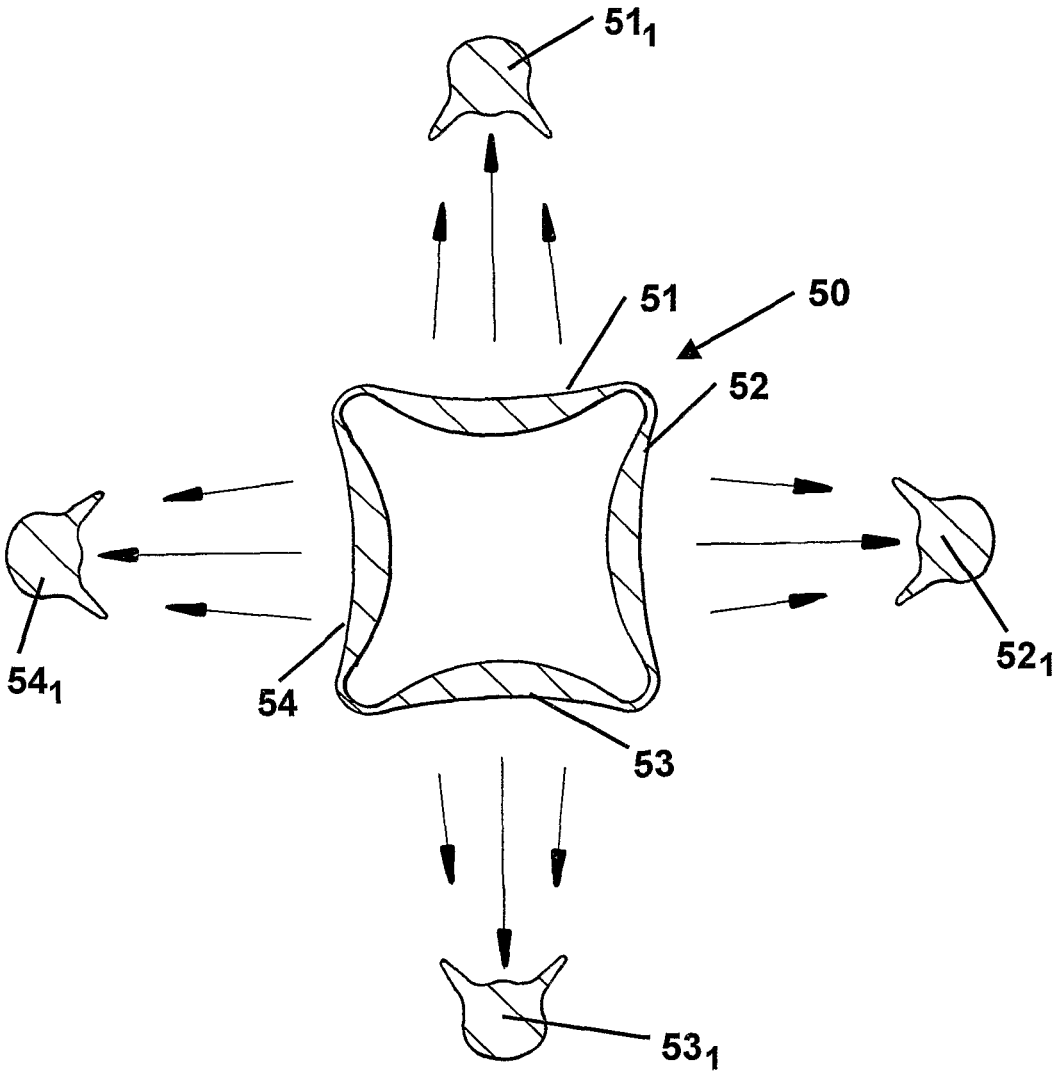
FIG. 7 is a transverse section of a fifth embodiment of the present invention being a tubular charge which is provided with four equally radially spaced faces.

FIG. 7 shows container 50 which, in cross-section, has an external profile generally square in shape with rounded corners and a slight concave aperture to the exterior side walls; however the interior surfaces of the container have greatly pronounced aperture of the side walls, as shown.

The container 50 shown in FIG. 7 cannot readily be formed from commercially available tubes since the wall thickness varies radially as shown in FIG. 7. Whereas extrusion of the shapes illustrated in FIGS. 1-6 is a feasible alternative to pressing round or square tubes in such metals as aluminium or magnesium, it is the only practicable production method for tubes having varying wall thickness.

Container 50 has four walls 51 to 54 which produces projectiles $\mathbf{51}_1$, $\mathbf{52}_1$, $\mathbf{53}_1$, $\mathbf{54}_1$ and so on each with a lens-shaped transverse section. The thickness of an increment of projectile material determines its inertia and, thence, its velocity as the detonation wave of the explosive strikes it. Variation of the thickness of increments of a projectile therefore modifies the velocity at which these increments are projected. A tendency for the projectile to disintegrate as it travels because its individual component increments are travelling at different velocities, or in different directions, can therefore be largely mitigated by causing all increments projected in approximately the same direction to be travelling at approximately the same velocity. The strength of the material can therefore suffice to hold the increments together in a coherent mass. Lens shapes are commonly used to achieve this incremental velocity adjustment, which can be optimised for the production of compact elongate masses of maximum stability in flight.

Aluminium based alloys are ideal for precise and rapid manufacture and the advantage in the present case of more rapid deceleration in flight than heavier metals which implies smaller danger zones.

Figure 8:
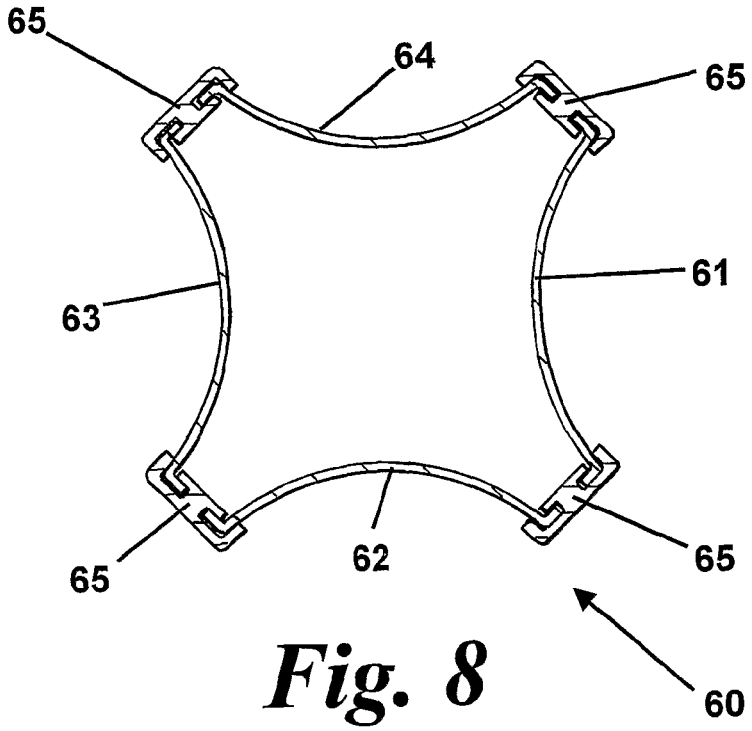
FIG. 8 is a sixth embodiment of the present invention being an array of elongate projectile elements joined along their edges by engagement with corner strips.

FIG. 8 shows container 60 which is fabricated by joining separate projectile components 61 to 64 along their edges using any known means of joining such as welding, brazing, the application of adhesive or the engagement of interlocking edges. Such interlocking edges might engage directly with each other or with additional corner pieces 65. Alternatively, or additionally, such elongate projectiles may be constrained together, edge to edge, by a surrounding frame or tube of plastics or metal.

Figure 9:
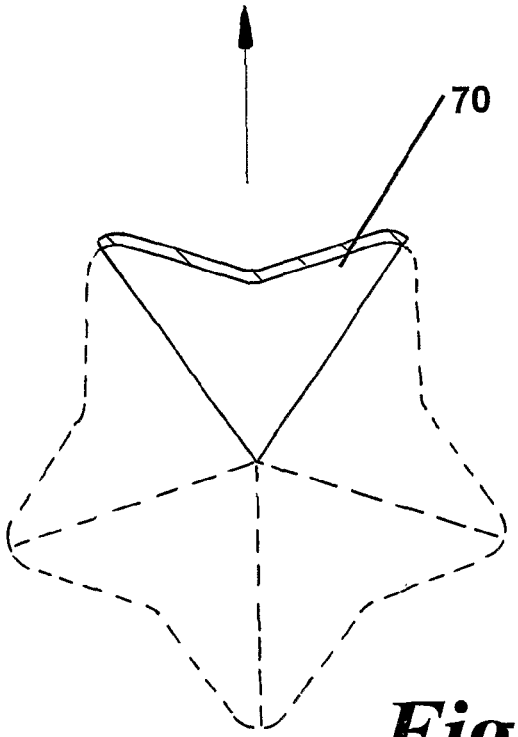
FIG. 9 is a transverse section of a seventh embodiment of the present invention, being a charge element for combination with five other such elements.

FIG. 9 shows a transverse section of a charge 70 which may be used alone, or as a component of an array of such charges to form a charge of equivalent shape and effect as that of FIG. 6. Thus FIG. 9 illustrates the use of charge 70 in the assembly of a radially symmetrical assembly which propels explosively formed projectiles in five equally spaced directions. It will be understood that an outward facing array of charges with a variable number of such charge units could be arranged according to the perceived requirement at the time of use.

The intended effects of conventional Bangalore torpedoes are the blast and fragment damage to adjacent structures. In many applications the, concomitant starting of fires would be disadvantageous in an already dangerous environment. In those instances in which an incendiary effect might be advantageous, however, the use of such incendiary metals as magnesium and its alloys, titanium or zirconium would be advantageous. Incendiary effect might also be obtained or augmented by the use of aluminised plastic or plastic-bonded explosive as the main fill. It will be understood that aluminium, when used for substantial parts of the cases of explosive charges, is little oxidised so makes little contribution to any incendiary effect: when the powdered metal is incorporated in explosive materials, however, it reacts exothermically with both endogenous oxygen of the explosive and with the surrounding air or water.

Alternatively, to a torpedo whose body is made from relatively non-incendiary materials, may be applied additional components made from incendiary materials.

Thus, by way of example, the incendiary effect of such a container as that illustrated in FIG. 7, itself made from aluminium or steel, may be applied an external tube of magnesium or, alternatively, strips of magnesium may be applied, by mechanically interlocking grooves and ribs, or by adhesive or sticky tape.

In a container assembled according to FIG. 8, the projectile components 61 to 64 might be made in steel or aluminium while the joining edge members 65 are made in magnesium.

In such applications as may require a minimal amount of projectile damage, then the tubular components of the container of the invention may be made from plastics or ceramic materials whose effective range is limited by stretching and tearing, giving a very large surface to mass ratio, and by extreme comminution respectively.

By Way of Example:

A strip of aluminium, 25 mm wide and 5 mm thick, was bent along its long axis to an angle of 170° and to its convex surface were stuck three strips of plastic explosive SX2, each 25 mm wide and 3 mm thick. This gave a calculated explosive load equivalent to 480 g/meter. This charge was fired at a distance of 1000 mm from a length of razor wire and a 5 mm thick plate of 43 A grade steel. Both the wire and the plate were cut. The projectile was not projected in a direction exactly normal to the long axis of the charge but was inclined forwards an angle of approximately 40.

It has been shown previously how the randomly shaped and distributed fragments of a metal cylinder filled with detonating explosive can be made cohesive and thus form elongate projectiles by forming the sides of the tube into concave or lens-sectioned longitudinal elements which remain intact and therefore act as longitudinal self-forging fragment projectiles. These maintain more consistent cutting properties at greater stand-off distances than do the fragments derived from explosive-filled tubes of uniform wall thickness.

Then follows an alternative means of mitigating the random fracture of explosive-filled metal tubes and thus producing similar elongate projectile elements.

Figure 10:
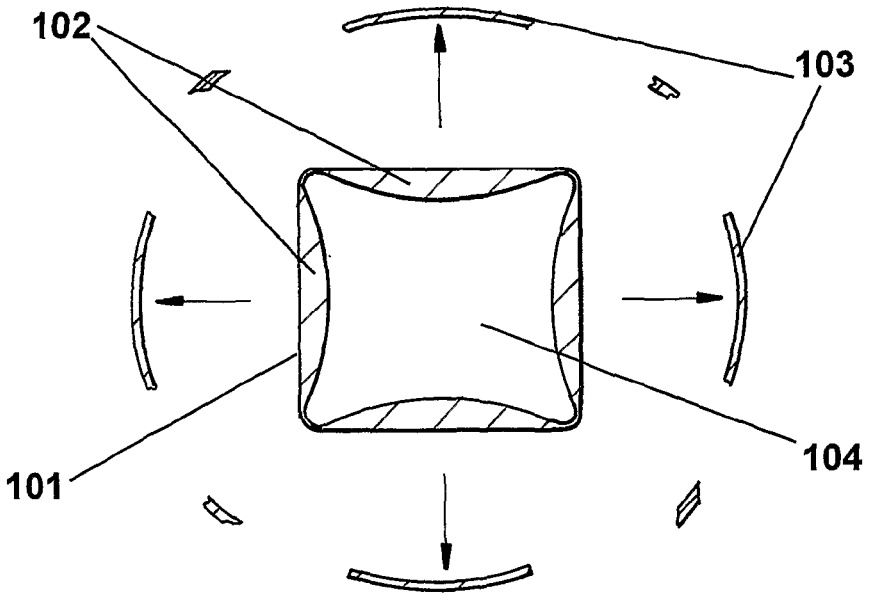
FIGS. 10 to 12 show further embodiments of the present invention.

Referring to FIG. 10, a square-sectioned metal tube 101 is substantially filled with a detonating explosive 104. Between each flat face 102 of the tube 1 is placed a shock wave refracting element 102. This is essentially lens sectioned or prismatic and the material used for its confection, and its shape, are determined according to its shock wave propagation velocity. Since the velocity of shock wave propagation will be lower than that of the detonation velocity of the explosive 104, the shock front will be refracted in the manner of light passing through a prism. The consequence of this refraction is that the otherwise divergent loci imparted to longitudinal elements of the tube 101 will be made parallel with, or even convergent towards, the longitudinal plane passing through the midline of each flat side 105 and normal to its surface.

The consequence of this mitigation of radial expansion of longitudinal elements of the tube 101 is that each side of the tube 101 remains largely coherent and constitutes a longitudinal projectile 103.

It will be understood that this principle is not limited to tubes having four sides.

Figure 11:
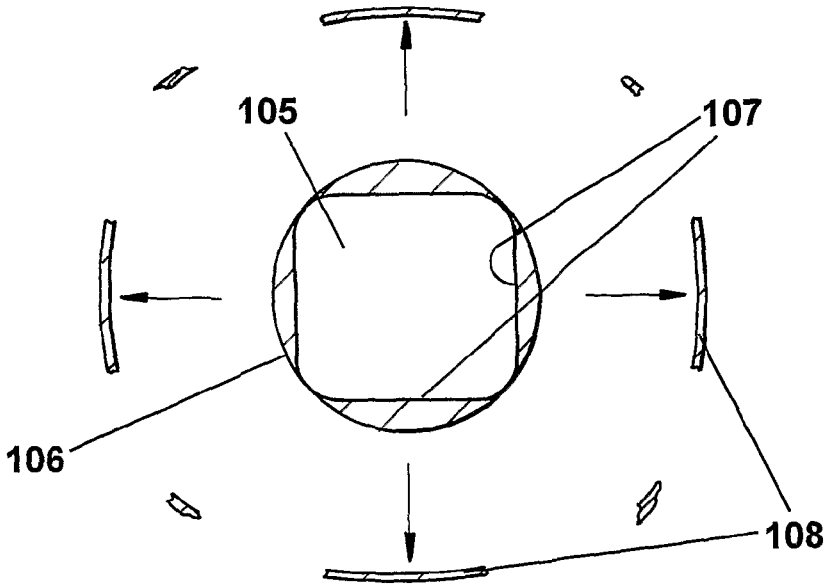

An alternative configuration is illustrated in FIG. 11 in which shock wave refracting elements 107 are applied to the inner wall of a cylindrical tube 106 containing explosive 105. The inner surface of the elements 107 may be flat or convex. An elongate projectile 108 is produced by each refracting element 107.

The greater the curvature of the inner surfaces of the wave shaping elements 102 and 107, and the slower the velocity of shock wave propagation therein, the greater the degree of convergence of the elements of the projectile material constituting the walls of the tubes 101 and 106.

Figure 12:
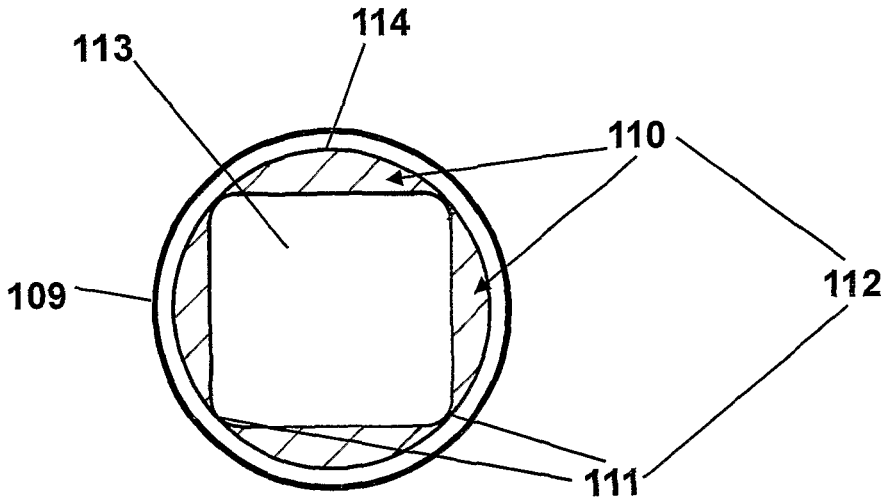

FIG. 12 shows a charge in which a metal tube 110 contains four refracting elements 110 which are joined by thin-walled sections 111. The refracting elements 110 and the joining elements 111 thus constitute a flexible lining element 112. This element 112 may be made either with flexible joining elements 111 or may be made from elastic material. This facilitates the insertion of the element 112 in the tube 109 before filling with explosive 113. Tamping or injection of explosive into the lumen of the element 12 inflates the element and urges its outer wall against the inner wall of the tube 109.

The use of a flexible or elastic lining element 113 has the further advantage of facilitating the filling of the charge with explosives which are initially made in the form of a paste but which set to form solids. Such explosives are typified by plastic bonded explosives in which a finely divided particulate explosive material, such as cyclo-tetramethylene tetranitramine (HMX), is dispersed in a viscous liquid matrix, such as hydroxyl terminated polbutadiene, which is mixed with a cross-linking substance, such as an organic diisocyanate, immediately before filling. Interaction of the last two components converts the viscous liquid into a rubbery solid. Such an explosive is typified by the composition PBXN-110.

Difficulty is frequently experienced in the filling of munitions with explosives having such a constituency because of the difficulty of excluding bubbles of air. By connecting a reservoir of such an explosive to the end of an evacuated, blind ended and inflatable element 112, flow of explosive into the tube 109 can be induced by the application of a vacuum to the space 114 between the inner wall of the metal tube 9 and the outer surface of the inflatable element 112. Simultaneous application of positive pressure to the open end of the element 112 assists the filling process and, in so doing, urges the outer surface of the element 12 against the inner surface of the tube 109.

The invention claimed is:

1. An explosive charge comprising a tubular container, said container being generally square shaped and containing an explosive material within said container, said container consisting of four walls, said four walls being equally radially spaced, said container consisting of four web-portion wall portions, said walls being linked by said web-portion wall portions, each of said four walls being a concave longitudinal flute of substantially uniform thickness, each of said flutes being straight and each of said flutes having a longitudinal axis substantially parallel to the longitudinal axis of said tubular container, each of said concave longitudinal flutes extending along substantially the entire length of said container and upon detonation of said explosive material, each of said flutes producing a coherent linear projectile, said linear projectiles providing a cutting effect applied in four equally spaced directions.

2. The charge according to claim 1, wherein said web-portion wall portions are rounded.

3. The charge according to claim 1, wherein said concave longitudinal flutes are rounded grooves.

4. The charge according to claim 1, wherein said concave longitudinal flutes each have a mid-line and are each symmetrical to said mid-line.

5. The charge according to claim 1, wherein said longitudinal flutes have a contour that, upon detonation, produce a focusing effect such that most of the material forming said longitudinal flutes form said coherent linear projectiles.

6. The charge according to claim 1, wherein the tubular container is formed from a material selected from the group consisting of plastic, ceramic, aluminium, magnesium, zirconium, and alloys of aluminium, magnesium and zirconium.

7. A linear explosively formed projectile charge for producing projectiles, the charge comprising an elongate casing being generally square shaped and having a compartment portion containing explosive material, said elongate casing consisting of four equally radially spaced longitudinal flutes which extend along substantially the entire length of said elongate casing, said flutes having substantially uniform thickness and being approximately spherical or hyperbolic, said elongate casing consisting of four web-portion flute portions, said flutes being linked by said web-portion flute portions, each of said flutes producing coherent linear explosively formed projectiles upon detonation of said explosive material, whereby in use no jet is formed in said coherent linear projectiles.

8. A tubular charge comprising a container, said container being generally square-shaped and containing an explosive material within said container, said container consisting of four concave longitudinal flutes which extend along substantially the entire length of said container, each of the concave longitudinal flutes having wall material of substantially uniform thickness, said container consisting of four web-portion flute portions, said flutes being linked by said web-portion flute portions, and upon detonation of said explosive material, each of the flutes forming a coherent linear projectile in which about 90% of the wall material in each of said flutes constitutes each said linear projectile.

9. A tubular container configured to hold an explosive material within said tubular container for use in an explosive charge, said tubular container consisting of four walls, said four walls being equally radially spaced, said container consisting of four web-portion wall portions, said walls being linked by said web-portion wall portions, each of said four walls being a concave longitudinal flute of substantially uniform thickness, each of said flutes being straight and each of said flutes having a longitudinal axis substantially parallel to the longitudinal axis of said tubular container, each of said concave longitudinal flutes extending along substantially the entire length of said container, each of said flutes being configured to produce a coherent linear projectile upon detonation of explosive material within said tubular container.

* * * * *